US006581427B2

(12) United States Patent
Gerritsen

(10) Patent No.: US 6,581,427 B2
(45) Date of Patent: Jun. 24, 2003

(54) METHOD OF ADJUSTING THE STROKE OF A PRESS BRAKE

(75) Inventor: Gerrit Gerritsen, Cuarnens (CH)

(73) Assignee: Beyeler Raskin S.A., Bussigny (CH)

( * ) Notice: Subject to any disclaimer, the term of this patent is extended or adjusted under 35 U.S.C. 154(b) by 108 days.

(21) Appl. No.: 09/768,713

(22) Filed: Jan. 24, 2001

(65) Prior Publication Data

US 2001/0009106 A1 Jul. 26, 2001

(30) Foreign Application Priority Data

Jan. 24, 2000 (EP) ..... 00810058

(51) Int. Cl.[7] ..... B21J 7/40; H01R 43/04; B21D 5/02

(52) U.S. Cl. ..... 72/31.11; 72/19.1; 72/20.1; 72/389.4; 72/441; 100/257; 29/753

(58) Field of Search ..... 72/389.4, 31.1, 72/31.11, 20.1, 19.1, 441, 446; 100/257; 29/753

(56) References Cited

U.S. PATENT DOCUMENTS

| | | | | |
|---|---|---|---|---|
| 4,378,717 A | * | 4/1983 | Schneider et al. | 100/257 |
| 4,550,586 A | | 11/1985 | Aubert et al. | |
| 4,621,517 A | * | 11/1986 | Hatanaka et al. | 72/19.1 |
| 5,092,026 A | * | 3/1992 | Klemmer et al. | 29/753 |
| 5,123,165 A | * | 6/1992 | Strong et al. | 29/753 |
| 5,140,834 A | * | 8/1992 | Kashiwagi et al. | 72/441 |
| 5,199,290 A | * | 4/1993 | Kashiwagi et al. | 72/446 |
| 5,269,163 A | * | 12/1993 | Yagi et al. | 72/20.1 |
| 5,493,959 A | * | 2/1996 | Yagi et al. | 100/257 |
| 5,697,146 A | * | 12/1997 | Inoue et al. | 72/19.1 |
| 6,233,988 B1 | * | 5/2001 | Kojima | 72/389.4 |

FOREIGN PATENT DOCUMENTS

| | | |
|---|---|---|
| CH | 686119 | 1/1996 |
| JP | 02030327 | 1/1990 |
| JP | 05138254 | 6/1993 |
| JP | 09136116 | 9/1997 |
| JP | 10052800 | 2/1998 |

* cited by examiner

*Primary Examiner*—David Jones
(74) *Attorney, Agent, or Firm*—Woodard, Emhardt, Naughton, Moriarty & McNett LLP

(57) ABSTRACT

A method of adjusting the stroke of a press brake having a movable beam (1) supporting a punch (2), a fixed beam (3) supporting a die (4), means of displacing (5, 5') the movable beam with respect to the fixed beam, said displacement means resting on side frames (6, 6') immovably attached to the fixed beam, linear encoders (9, 9') for measuring the displacement of the movable beam with respect to the side frames, at least one sensor (8, 8') measuring a physical parameter (p) varying with the force exerted by said punch on a metal sheet placed on said die, and an electronic device for controlling (7) the bending movement controlling the speed of said displacement movement between top dead center and bottom dead center (BDC), provided with a calculation means for correcting the value of said bottom dead center depending on the measurement of said displacement and said physical parameter. The difference in thickness between the actual thickness of the metal sheet and the reference value (e) of the thickness of the metal sheet is measured by comparing the actual position of said displacement at which there occurs a predetermined variation Δp of said physical parameter (p) with the theoretical position of said displacement where this variation Δp should occur, and the electronic control device (7) calculates a correction of bottom dead center by taking account of said difference in thickness.

9 Claims, 2 Drawing Sheets

METHOD OF ADJUSTING THE STROKE OF A PRESS BRAKE

FIELD OF THE INVENTION

The present invention relates to a method of adjusting the stroke of a press brake having a movable beam supporting a punch, a fixed beam supporting a die, displacement means for displacement of the movable beam with respect to the fixed beam, the displacement means resting on side frames immovably attached to the fixed beam, linear encoders for measuring the displacement of the movable beam with respect to the side frames, at least one sensor measuring a physical parameter varying with the force exerted by the punch on a metal sheet placed on the die and an electronic control device for controlling the bending movement, controlling the speed of the displacement movement of the movable beam between a top dead centre and a bottom dead centre and provided with a calculation means for correcting the value of the bottom dead centre depending on the measurement of said displacement and said physical parameter.

BACKGROUND OF THE INVENTION

Patent CH 686119 from the applicant describes a press brake of this type. During bending of a metal sheet, the force suffered by the side frames of a press under the effect of the thrust of the cylinders causes flexing of the side frames, which can result in a deformation of the frame of up to 1–2 mm. This flexing alters the depth of penetration of the punch into the die, which creates an error in the bending angle obtained on the piece to be bent. In the adjustment method according to CH 686119, the force suffered by each of the side frames under the action of the movable beam displacement means is determined, for example by means of pressure sensors, and each of the values obtained is compared with a predetermined diagram establishing the relationship between the force suffered by the respective side frame and the flexing of the side frame, and the stroke of the movable beam is increased so as to compensate for the bending errors due to the deformations of the press, in particular due to the flexing of the side frames.

Another parameter capable of generating an error in the bending angle is the variability in the thickness of the metal sheet processed. The nominal thickness of the metal sheet is one of the parameters entered into the control electronics of the press brake during initial adjustment of the stroke.

In principle, the actual thickness of the metal sheet must be measured each time by the operator. This is because sheet steel manufacturers supply sheets whose actual thickness has variations which may be up to 10% of the nominal value of the thickness. If a metal sheet of 2 mm nominal thickness has, for example, to be bent at 90° in a 12 mm V-shaped opening, a±10% variation in the thickness will, if it is not corrected, result in a bending angle variation between 88° and 92°.

The operator should therefore, before each bending operation, measure the actual thickness of the metal sheet he is going to process and enter this data into the control electronics of the press brake so that said press brake can correct the stroke of the movable beam.

Experience shows that this preliminary measurement is unfortunately often neglected by the operators, which causes the production of a number of pieces whose bending angle is outside the tolerance limits.

The aim of the present invention is to propose a method of adjusting the stroke of a press brake taking into account the variations in the actual thickness of the metal sheets processed, without requiring intervention from the operator.

SUMMARY OF THE INVENTION

To that end, the invention proposes a method of the field as defined above, in which the difference between the actual thickness of the metal sheet and the reference value (e) of the thickness of the metal sheet is measured by the electronic control device of the press, by comparing the actual position of the displacement at which there occurs a predetermined variation of a physical parameter varying with the force exerted by the punch on the metal sheet placed on the die, with the theoretical position of the displacement where this predetermined variation should occur, and in which the electronic control device calculates a correction of the bottom dead centre by taking account of this difference in thickness.

Preferably, in order to detect more precisely said actual displacement position where the variation Δp occurs, the speed of the displacement movement is reduced to a measurement acquisition speed (vam), less than a predetermined bending speed (v1), when the punch is at a predetermined distance from the theoretical pinching level of the metal sheet—that is to say, the level reached by the beam during its descent, where the metal sheet starts to be pinched between punch and die, if the thickness of the metal sheet has the reference value (e)—greater than the manufacturing thickness tolerance Δe of said sheet, and the speed of the displacement movement increases to said bending speed after detection of said predetermined variation Δp of said physical parameter (p).

According to a preferred embodiment of the invention, the displacement of the movable beam is carried out at approach speed from top dead centre to a predetermined safety distance with respect to the theoretical pinching level, the distance where the speed is reduced to a bending speed; the speed of the beam is again reduced to a measurement acquisition speed, at a measurement acquisition distance, that is to say at a distance with respect to this theoretical pinching level equal to or greater than the manufacturing thickness tolerance of the metal sheet; the speed is maintained at this measurement acquisition speed over a displacement distance equal to at least twice the measurement acquisition distance; the displacement speed is then increased again to the bending speed. Finally, it is reduced and brought back to zero at the approach of bottom dead centre (BDC).

While the displacement speed of the movable beam is reduced to the measurement acquisition speed, the system can perform a large number of measurement cycles on the physical parameter per unit length of displacement and can therefore detect precisely the start of the variation of this parameter, as well as the precise position where the variation of the parameter exceeds a predetermined value, which signifies that the punch has come into contact with the metal sheet and is starting to pinch said sheet.

The control electronics determines the actual thickness of the metal sheet while the beam is descending at the reduced measurement acquisition speed and recalculates the bending operation parameters, notably a correction of bottom dead centre (BDC).

Correction of bottom dead centre comprises a geometrical level correction due to the over- or under-thickness of the metal sheet. In addition, the thickness of the metal sheet is a parameter which determines to a great extent the reactive force suffered by the press, notably the side frames, during bending, and, consequently, the deformation of the press and the penetration error of the punch which results therefrom. From preliminary tests, it is possible to produce a chart or algorithm linking actual thickness and deformation of the press and correct the penetration error from the measurement of the actual thickness alone.

It is however possible, during a bending operation, to measure both the actual thickness of the metal sheet when the pinching starts and the reactive force suffered by the press during the bending itself and to carry out the bottom dead centre correction from these two distinct measurements.

Two different parameters can be used for determining the variations in thickness of the metal sheet and the flexing suffered by a side frame.

If, for determining the variations in thickness of the metal sheet, the choice is made of a physical parameter which is also representative of the geometrical deformations of the press, this same parameter makes it possible to correct for both the variations in sheet thickness, by detecting an initial variation Δp of the parameter, and the deformation of the press, by measuring the maximum variation of the parameter during bending.

Preferably, the force suffered by the side frames under the action of the beam displacement means is determined during the bending operation by measurement of the same physical parameter and compared with a diagram establishing the relationship between force suffered by a side frame and flexing of said side frame, and the stroke of the movable beam is also increased so as to compensate for the bending errors due to the deformations of the press from this measurement, besides correction of the errors due to variations in thickness of the metal sheet.

If the displacement means of the press brake comprise two hydraulic cylinders associated respectively with two side frames, the value of the physical parameter can be measured at each side frame and the electronic control device can independently correct the stroke of each cylinder to its bottom dead centre, or recalculate a common correction value from these two measurement zones.

The physical parameter chosen can be the hydraulic pressure prevailing in the upper part of a cylinder.

The physical parameter can also be the mechanical stress exerted by a cylinder on the movable beam.

The physical parameter can also be the distance between a point in the top part and a point in the bottom part of the frame of the press.

The physical parameter can also be a mechanical stress suffered by part of the frame of the press.

Other features and advantages of the present invention will emerge in the description below of preferred embodiments, referring to the accompanying drawings.

DETAILED DESCRIPTION OF PREFERRED EMBODIMENTS

Figure 1A:
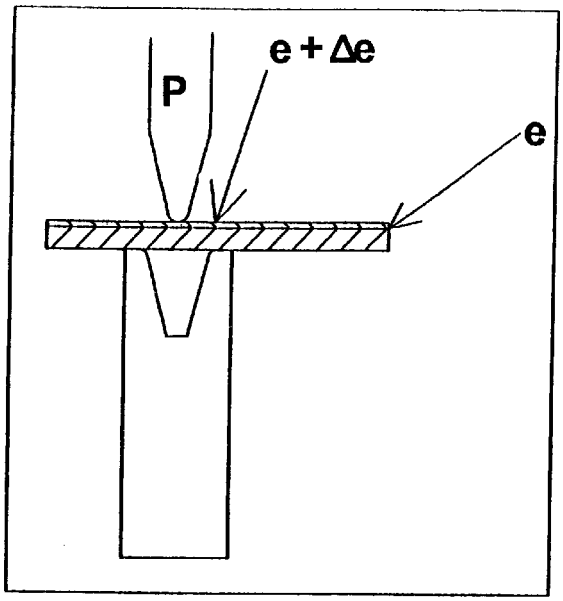
FIGS. 1*a* and 1*b* are schematic views illustrating the effect of a variation in thickness of a metal sheet on the punch/sheet contact point.
Figure 1B:
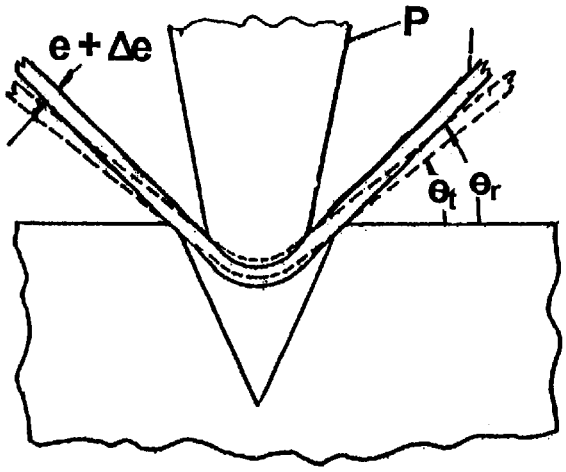

FIG. 1*a* shows that, for a metal sheet whose actual thickness e+Δe is greater than the nominal thickness e, the punch P comes into contact sooner than the initial adjustment makes provision for. If bottom dead centre is not corrected, in this case upward, the bending is excessive, as illustrated in FIG. 1*b* showing that the actual bending results in an angle θr greater than the theoretical angle θt of a sheet of nominal thickness, depicted in dotted lines.

Figure 2:
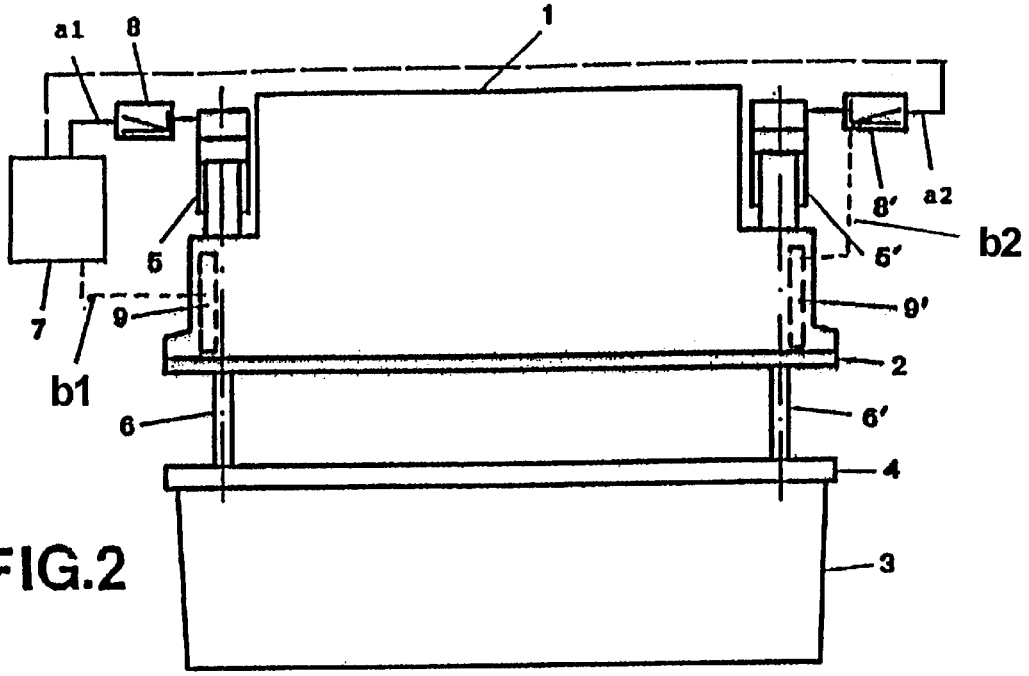
FIG. 2 is a schematic front view of a press brake equipped with a pressure sensor and control electronics.

The press brake depicted in FIG. 2 has a movable beam 1 supporting a punch 2 and a fixed beam 3 supporting a die 4. The displacement of the movable beam is performed by means of two hydraulic cylinders 5, 5', mounted on two respective side frames 6, 6' immovably attached to the lower beam. Two linear encoders 9 and 9', mounted on the movable beam 1, make it possible to measure the displacement of the movable beam with respect to the respective side frames 6 and 6'. The bending movement is controlled by an electronic control device 7. Two pressure sensors 8 and 8' are mounted respectively on each of the cylinders so as to detect the pressure at the upper part of each of them. The electronic control device is arranged so as to process the signals a1 and a2 issuing respectively from each of the pressure sensors and to also process two signals b1 and b2 issuing from the linear encoders 9 and 9' and representative of the displacements of the movable beam with respect to each of the side frames 6 and 6'.

Figure 3:
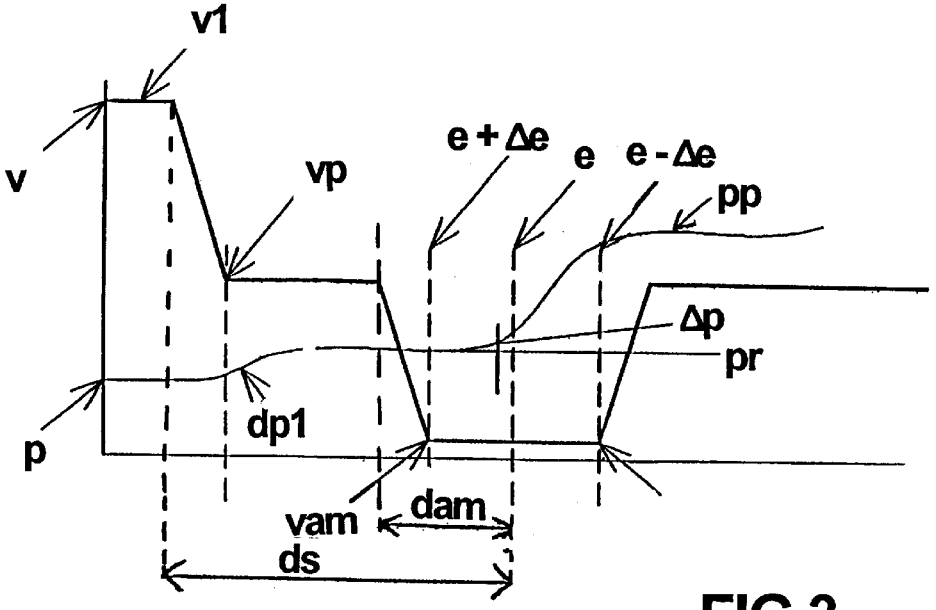
FIG. 3 is a diagram illustrating the displacement of the beam during a bending operation according to the invention.

The diagram of FIG. 3 illustrates the method according to the invention. It shows the speed of descent v of the movable beam and shows at the same time the variation in hydraulic pressure p measured at a pressure sensor 8 or 8'. The descent takes place to begin with at a high approach speed v1 until a predetermined distance is reached with respect to the level where the punch theoretically pinches the metal sheet, referred to as the safety distance ds. At this moment, the speed is decreased to a bending speed vp, prescribed by the composition and nominal thickness of the metal sheet as well as by the characteristics of the desired bending, the bending angle and tool profile. This speed can be typically of the order of 10 mm/s. If the nominal thickness of the metal sheet is designated by e, and the tolerance on the thickness by Δe, the actual thickness of the sheet will be in the range e±Δe. When the punch is situated at a distance, referred to as the measurement acquisition distance, dam, from the theoretical pinching level, slightly greater than Δe, the speed of descent is reduced to a measurement acquisition speed, vam, which is of the order of one tenth of the bending speed vp, that is typically 1 mm/s.

During the entire descent, the pressure sensors 8 and 8' measure the hydraulic pressure p at each of the cylinders 5 and 5' and the control device 7 records and processes it. The variation in pressure is depicted (in arbitrary units) on the diagram of FIG. 3. The reduction in the speed of descent v, from the approach speed v1 to the bending speed vp, is accompanied by an attendant slight increase in pressure dp1. The value of the pressure then reached, during the phase of descent to the bending speed and before contact is made with the sheet, is considered as the reference value pr of this parameter. One pressure measurement cycle of the sensor+electronic control device assembly lasts around 10 ms: in this way, while the beam is descending at a bending speed vp of the order of 10 mm/s, a pressure measurement is performed every 0.1 mm; when the speed of descent is reduced to the measurement acquisition speed vam, a pressure measurement is performed every 0.01 mm. The device is therefore in a position to determine very precisely the moment at which the pressure p increases again by an amount Δp, representative of the punch coming into contact with the upper face of the metal sheet. A value of Δp of the order of 1 bar can be chosen. This contact can be made at any point whatsoever situated between the points representing respectively sheets of thickness e+Δe and e−Δe. A comparison of the level at which contact is made with the theoretical pinching level determines the difference between actual and nominal thickness of the sheet and the control device 7 immediately recalculates a bottom dead centre.

After contact has been made, the pressure measured at a sensor 8, 8' level increases in accordance with an S-shaped curve until reaching a value pp, the bending pressure, often of the order of 300 bars, beyond which it varies little. The difference in value pp−pr determines the deformation of the side frames and other parts of the press. The electronic control device 7 compares the value of pp or of (pp−pr) with an algorithm specific to this press brake, recorded in memory, establishing the relationship between this value and the deformation of the fixed parts of the press, conditioning a penetration error of the punch dy. The stroke of the punch can then automatically be corrected accordingly: the position of bottom dead centre of the movable beam (BDC) is thus increased by the value dy at each side frame, so as to create a bending movement independent of the load of the press.

Once the level of the actual point at which the punch comes into contact with the metal sheet is established, the descent of the movable beam can be continued at the bending speed, it being possible to calculate the value of dy and use it for a BDC correction while the bending is performed at the speed vp.

In the diagram of FIG. 3, the speed of descent of the beam re-accelerates from the value vam to the value vp after a distance 2 Δe has been travelled at the speed vam. The distance over which the beam descends at the speed vam can also be programmed to a slightly higher value, for example 2×dam. The acceleration could also be programmed to take place as soon as the variation Δp is detected. Persons skilled in the art will easily understand that the movement of the beam described above can be programmed in accordance with many variants without departing from the scope of the invention: the variation in speed between the points ds and dam can be programmed differently. The speed can for example change directly from the fast approach speed v1 to the slow measurement acquisition speed vam without being maintained at an intermediate constant value vp. In other words, in this case, ds=dam.

The hydraulic pressure of the oil at the top of the cylinders is a parameter representative of all the phenomena and is easy to measure with sensors known per se. Moreover, it has the advantage of being able to be correlated both with the punch coming into contact with the metal sheet and with the maximum deformation of the press brake during the operation in progress.

However, those skilled in the art will easily understand that other measurable physical parameters can represent all or part of the process. During the descent of the movable beam, before contact is made with the metal sheet, the beam and the punch are suspended and, on account of their weight, exert a force directed downwards on the frame of the press. At the moment contact is made with the metal sheet, the resultant of the forces changes direction on account of the reactive force.

By way of non-limitative examples of measurable parameters, the following can be cited:

the mechanical stress exerted by a cylinder on the movable beam can be measured by means of stress meters. This stress has a sudden change in value when the punch comes into contact with the metal sheet, which results in a measurable variation of a few mV, to then reach a maximum value, of the order of one volt, which can be correlated with the deformation of the press.

the distance between an element in the top part and an element in the bottom part of the frame of the press can be measured by electromechanical sensors, known per se, capable of detecting variations in distance of the order of one μm. The start of the variation in the electrical signal represents the punch coming into contact with the metal sheet.

a measurement by means of stress meters can also be made of the mechanical stress suffered by part of the frame, rather than a measurement of the mechanical stress between cylinders and movable beam.

Variations in the physical parameter chosen can be measured at a single point of the press. If they are measured at two different places, for example at two lateral side frames, the values measured and the bottom dead centre corrections they determine can be applied independently at the two side frames or averaged in order to apply an overall correction.

What is claimed is:

1. A method of adjusting a stroke of a press brake having a movable beam supporting a punch, a fixed beam supporting a die, displacement means for displacing the movable beam with respect to the fixed beam, said displacement means resting on side frames immovably attached to the fixed beam, linear encoders for measuring a displacement of the movable beam with respect to the side frames, at least one sensor measuring a physical parameter (p) varying with the force exerted by said punch on a metal sheet placed on said die, and an electronic bending control device controlling the speed of the movable beam between top dead centre and bottom dead centre (BDC), said control device being provided with calculation means for correcting said bottom dead centre depending on a measurement of said displacement of the movable beam and a measurement of said physical parameter (p), wherein the difference in thickness between the actual thickness of the metal sheet and a reference value (e) of the thickness of the metal sheet is determined by said control device by comparing the actual position of said displacement of the movable beam at which there occurs a predetermined variation Δp of said physical parameter (p) with the theoretical position of said displacement of the movable beam where this variation Δp should occur if the thickness of the metal sheet would have the reference value (e), and wherein said bending control device calculates a correction of bottom dead centre by taking account of said difference in thickness, wherein a speed of the movable beam is reduced to a measurement acquisition speed (vam), less than a predetermined bending speed (v1), when the punch is at a predetermined distance from a theoretical pinching level of the metal sheet greater than a manufacturing thickness tolerance Δe of said sheet, and wherein the speed of the movable beam increases to said bending speed after detection of said predetermined variation Δp of said physical parameter (p).

2. A method according to claim 1 wherein said displacement is carried out at an approach speed (v1) from top dead centre to a predetermined safety distance (ds) of the punch with respect to the theoretical pinching level of the metal sheet, where the speed is reduced to a bending speed (vp), wherein the speed is again reduced to a measurement acquisition speed (vam), at a measurement acquisition distance (dam) of the punch with respect to said theoretical pinching level equal to or greater than the manufacturing thickness tolerance Δe of said metal sheet and maintained at said measurement acquisition speed (vam) over a distance substantially equal to at least twice said measurement acquisition distance (dam), and in that the speed is then increased again to said bending speed (vp).

3. A method according to claim 2, characterised in that said measurement acquisition speed (vam) is around one tenth of the bending speed (vp).

4. A method according to claim 1, characterised in that said physical parameter is chosen from amongst parameters representative of a geometrical deformation of the press.

5. A method according to claim 1, characterised in that the bending control device compares the measured values of said physical parameter (p) with a predetermined algorithm establishing the relationship between said physical parameter (p) and a deformation of fixed parts of the press and corrects bottom dead centre by taking account of said deformation.

6. A method according to claim 1 for a press brake whose displacement means comprise two hydraulic cylinders associated respectively with two side frames, wherein said physical parameter is the hydraulic pressure measured at the upper part of a cylinder.

7. A method according to claim 1, wherein said physical parameter is the mechanical stress exerted by a cylinder on the movable beam measured at this level by a stress meter.

8. A method according to claim 1, wherein said physical parameter is a mechanical stress suffered by part of the frame of the press measured at said part by means of a stress meter.

9. A method according to claim 1, wherein said physical parameter is the distance between a point in a top part and a point in a bottom part of the frame of the press.

* * * * *